US007356953B2

(12) United States Patent
Davis

(10) Patent No.: US 7,356,953 B2
(45) Date of Patent: Apr. 15, 2008

(54) KINETIC DISPLAY ASSEMBLY

(75) Inventor: Samuel Davis, 89 Sultana Avenue, Toronto, Ontario (CA) M6A 1T4

(73) Assignee: Samuel Davis, Toronto, Ontario (CA)

( * ) Notice: Subject to any disclaimer, the term of this patent is extended or adjusted under 35 U.S.C. 154(b) by 282 days.

(21) Appl. No.: 11/223,983

(22) Filed: Sep. 13, 2005

(65) Prior Publication Data

US 2007/0056197 A1 Mar. 15, 2007

(51) Int. Cl.

| | |
|---|---|
| ***G09F 19/14*** | (2006.01) |
| ***G09F 19/00*** | (2006.01) |
| ***B65D 27/00*** | (2006.01) |
| ***A45C 1/00*** | (2006.01) |

(52) U.S. Cl. ..... 40/453; 40/470; 40/437; 229/68.1; 206/0.81; 206/0.84

(58) Field of Classification Search ..... 40/453, 40/437, 780, 786, 788, 789, 124.16, 124.19, 40/774, 738; 428/77; 281/38, 9, 10, 12, 281/14; 283/56, 51; 101/486
See application file for complete search history.

(56) References Cited

U.S. PATENT DOCUMENTS

| | | | | |
|---|---|---|---|---|
| 3,159,329 | A * | 12/1964 | Hiersteiner | 229/68.1 |
| D224,877 | S | 10/1972 | Fendrick | |
| D271,168 | S | 11/1983 | Antonczyk | |
| 4,422,253 | A * | 12/1983 | Babberl | 40/453 |
| 4,546,019 | A | 10/1985 | Schneider | |
| 4,937,960 | A | 7/1990 | Otake | |
| D316,346 | S | 4/1991 | Jackson et al. | |
| 5,236,365 | A | 8/1993 | Badami | |
| 5,407,718 | A | 4/1995 | Popat et al. | |
| 5,598,650 | A * | 2/1997 | Brown | 40/453 |
| 6,306,479 | B1 | 10/2001 | Feiertag | |

OTHER PUBLICATIONS

Canadian Industrial Design Registration No. 44083.
Sheet 2158 from Official Gazette dated Aug. 30, 1983.
Lifestyles Pre Spring 1987 vol. 14. No. 87.

* cited by examiner

*Primary Examiner*—Lesley D. Morris
*Assistant Examiner*—Syed A Islam
(74) *Attorney, Agent, or Firm*—Bereskin & Parr

(57) ABSTRACT

A display assembly is provided comprising; (a) an image insert, the image insert being bendable from a planar configuration to a non-planar display configuration, wherein the image insert comprises a plurality of first surfaces for displaying a first image, and a plurality of second surfaces for displaying a second image; and (b) a display frame for supporting the image insert in the non-planar display configuration. The display frame comprises an abutment structure for abutting the plurality of first surfaces and the plurality of second surfaces to secure the plurality of first surfaces at a non-zero angle relative to the plurality of second surfaces and to resist unbending of the image insert. Optionally, the display assembly may be part of a book.

17 Claims, 16 Drawing Sheets

FIGURE 10b
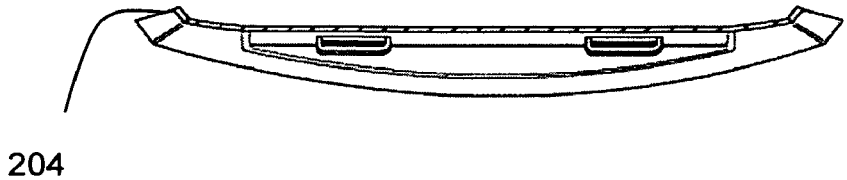
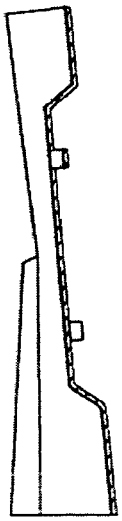
FIGURE 10a
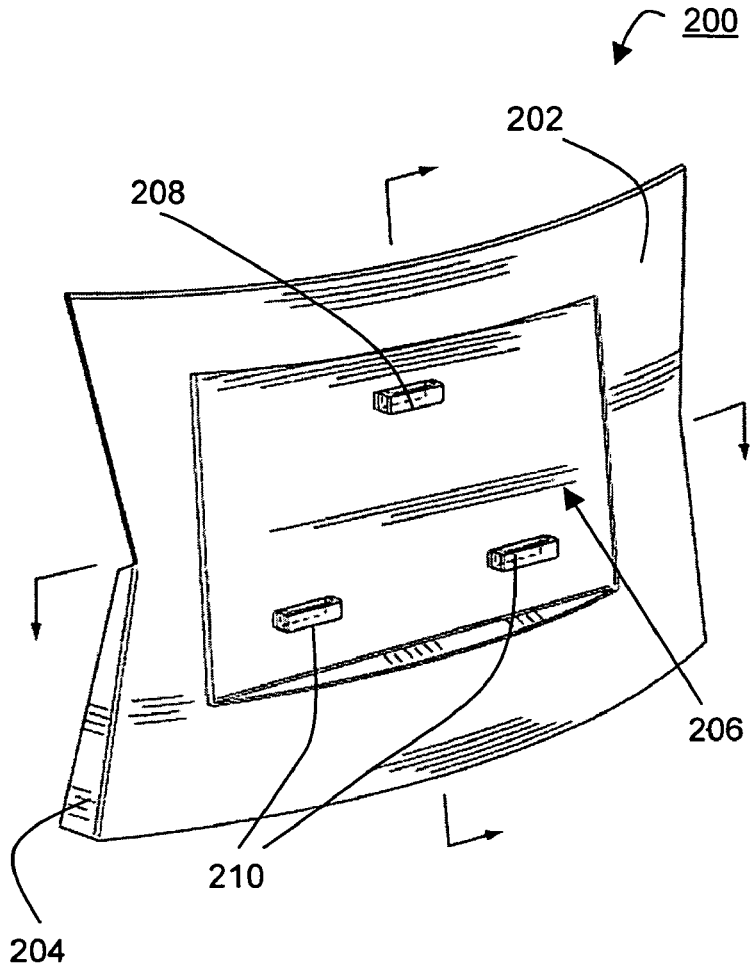
FIGURE 10

KINETIC DISPLAY ASSEMBLY

FIELD OF THE INVENTION

Embodiments of the invention relate generally to the field of displays for artistic works and more particularly to the display of three-dimensional artworks.

BACKGROUND OF THE INVENTION

Displays that are shaped in a pleated or accordion-style manner can be used to display multiple images, where the image seen by the viewer depends on the position of the viewer. Such artwork images are often called kinetic artwork or kinetic artwork images, and are generally discussed in the U.S. Pat. No. 6,306,479.

SUMMARY OF THE INVENTION

In accordance with an aspect of the invention, there is provided a display assembly comprising; (a) an image insert, the image insert being bendable from a planar configuration to a non-planar display configuration, wherein the image insert comprises a plurality of first surfaces for displaying a first image, and a plurality of second surfaces for displaying a second image; and (b) a display frame for supporting the image insert in the non-planar display configuration. The display frame comprises an abutment structure for abutting the plurality of first surfaces and the plurality of second surfaces to secure the plurality of first surfaces at a non-zero angle relative to the plurality of second surfaces and to resist unbending of the image insert.

In accordance with a second aspect of the invention, there is provided a book comprising (a) a plurality of pages, each page in the plurality of pages having a spine edge and a free edge opposite to the spine edge; (b) a spine for securing the plurality of pages together, the spine being attached to the spine edge for each page in the plurality of pages; (c) an image insert for displaying a first image and a second image, the image insert being bendable from a planar configuration to a non-planar display configuration, wherein the image insert comprises a plurality of first surfaces for displaying a first image, and a plurality of second surfaces for displaying a second image; and (d) a display frame for supporting the image insert in the non-planar display configuration. The display frame comprises an abutment structure for abutting the plurality of first surfaces and the plurality of second surfaces to secure the plurality of first surfaces at a non-zero angle relative to the plurality of second surfaces and to resist unbending of the image insert. Before assembly, the image insert is detachably attached to one of the spine and at least one page in the plurality of pages in the planar configuration; and the display frame is detachably attached to one of the spine and at least one page in the plurality of pages

BRIEF DESCRIPTION OF THE DRAWINGS

For a better understanding of embodiments of the invention, and to show more clearly how they may be carried into effect, reference will now be made, by way of example, to the accompanying drawings in which:

FIG. 10 is a perspective view of a display frame according to another embodiment of the invention;

FIG. 10*a* is a side view of a section of the display frame of FIG. 10; and FIG. 10*b* is a top view of a section of the display frame of FIG. 10.

DETAILED DESCRIPTION

Aspects of the invention involve a display assembly comprising an image insert, the insert being bendable from a planar configuration to a non-planar, or accordion-like, configuration. The image insert has a number of first and second surfaces for displaying portions of a first image and portions of a second image respectively. The display assembly further comprises a display frame for supporting the image insert in the non-planar configuration. The display frame, in turn, includes an abutment structure for abutting the first and second surfaces to secure the first surfaces at a non-zero angle relative to the second surfaces. The abutment structure resists the image insert unbending and returning to the planar configuration.

In some embodiments, the image insert has a number of fold lines defining alternating first and second surfaces, wherein each of the first surfaces is adjacent to and separated from a second surface by a fold line.

In one embodiment, the abutment structure comprises a pair of curved bands connected to an upright member of the display frame. At least one of the bands has a series of abutments, such as notches or tabs, spaced along the band to secure the image insert to the display frame, and to keep the image insert in its non-planar configuration. Specifically, the notches and tabs are arranged to ensure that the first and second surfaces remain at the non-zero angle relative to each other to ensure optimum viewing for a viewer. In some preferred embodiments, this non-zero angle will be approximately 90 degrees.

Other embodiments of the invention involve a book having a plurality of pages. Each page has a spine edge and at least one free edge. The spine edge is attached to the spine of the book to secure the pages together. An image insert, in a planar configuration, is attached by a spine edge to the spine of the book. A display frame is also attached to the spine of the book using a spine edge. The image insert and display frame are removable to provide a display assembly.

Features of various embodiments of the invention are discussed in greater detail below with reference to the appended figures.

Figure 1:
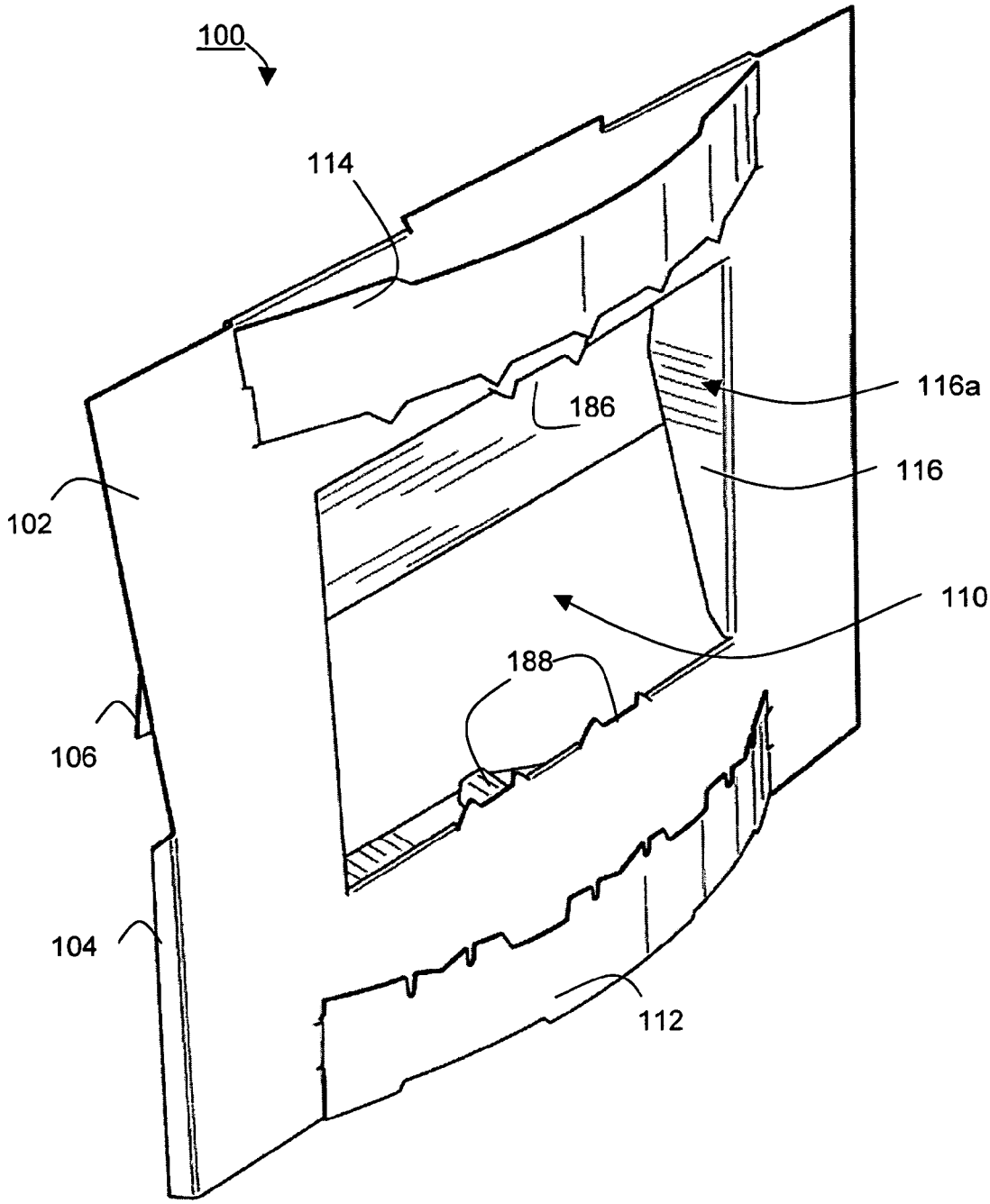
FIG. 1 is a front perspective view of an assembled display frame for use with a kinetic artwork insert according to one embodiment of the invention.
Figure 1A:
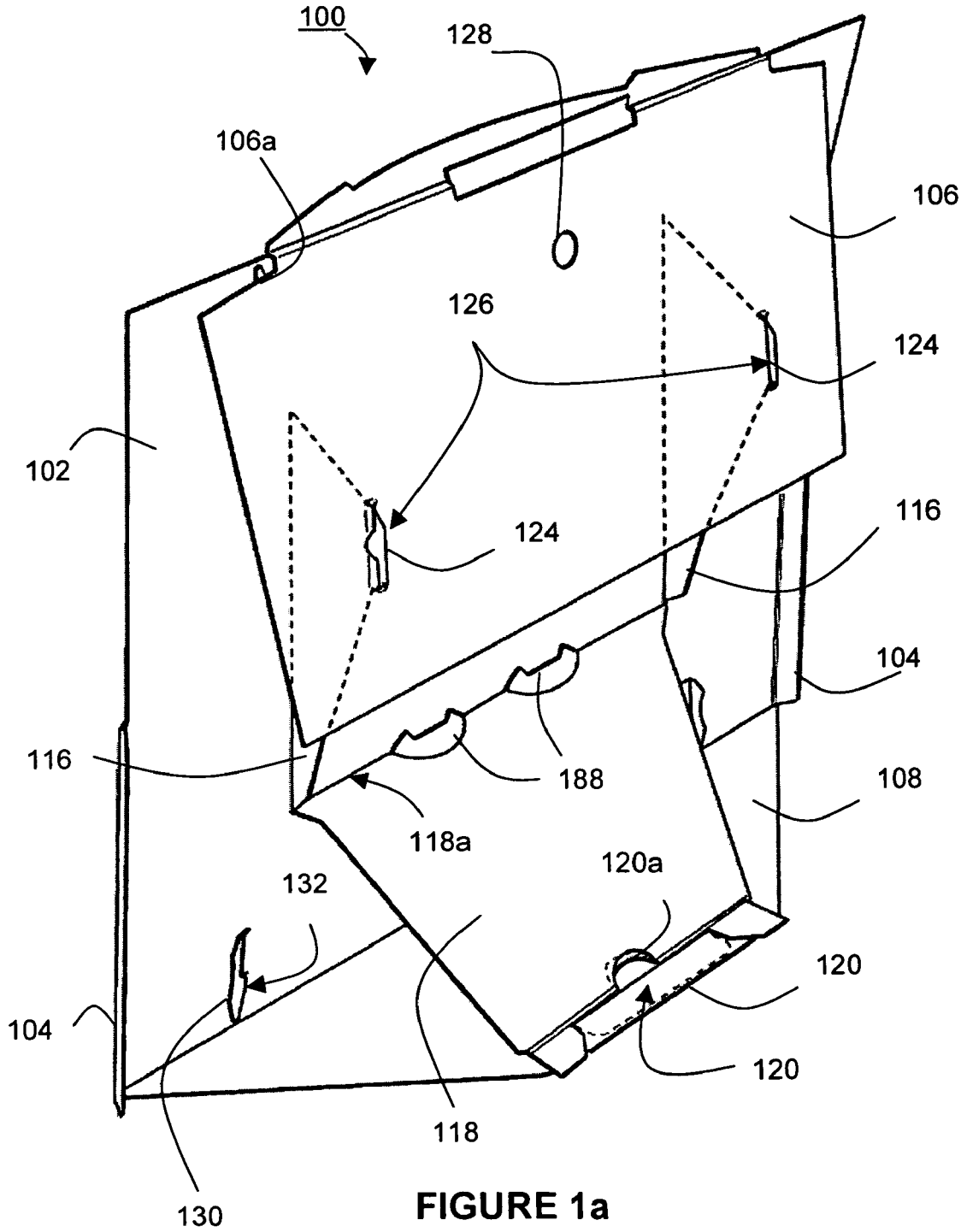
FIG. 1*a* is a rear perspective view of the assembled display frame of FIG. 1.
Figure 2:
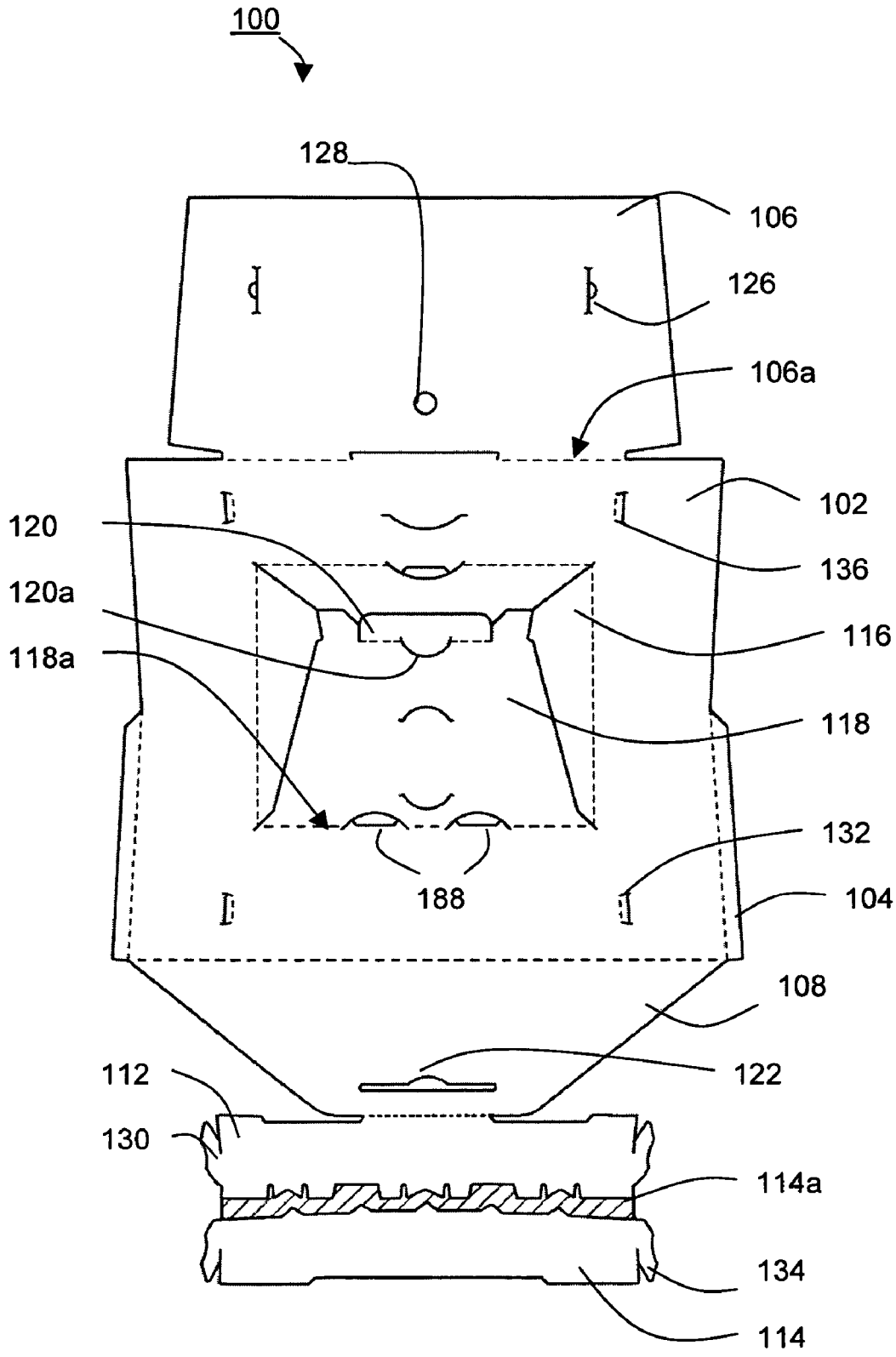
FIG. 2 is a plan view of the unassembled display frame of FIG. 1.

With reference to FIG. 1, FIG. 1*a* and FIG. 2, an assembled display frame 100 comprises an upright member 102 having support fins 104, an upper support 106, a base member 108, and an opening 110 cut through the center of the upright member 102. Two curved abutment bands, lower band 112 and upper band 114, are attached to the upright member 102 at a lower and upper portion respectively. The display frame 100 further comprises center support flaps 116 that fold away from the upright member 102 along fold lines 116*a*, and a rear support flap 118 connected to the upright member 102 along fold line 118*a*.

The base member 108 sits on a ground surface to support and hold the upright member 102 in a substantially vertical position relative to the ground surface. The support fins 104 provide additional support, protruding off the sides of the upright member 102 at a generally non-zero angle and extending vertically to provide additional rigidity to prevent the display frame 100 from tipping. In one preferred embodiment, the angle between the support fins 104 and the upright member 102 is about 45 degrees. In another embodiment, this angle is approximately 90 degrees.

The rear support flap 118 provides additional support for spacing the upright member 102 from the base member 108. When assembled, the rear support flap 118 is engaged with the base member 108 by a tab 120 fitted into a keyhole 122 in base member 108. The base member 108 and rear support flap 118 form a generally triangular shape with the upright member 102 to space the upright member 102 from the base member 108.

The upper support 106 provides additional rigidity to the upright member 102. The upper support 106 is attached to the upright member 102 at fold edge 106*a*, and is supported by the center support flaps 116 by engagement of tabs 124 with slots 126, providing increased rigidity. The upper support flap 106 may also contain a mounting hole 128 which can be used to mount the display frame 100 on a vertical surface, for example by placing a hook through the mounting hole 128.

Images, for example those images complementing the kinetic artwork insert, advertising images, or a calendar, may be printed on one or more portions of the display frame such as the upright member 102, the rear support member 118 and the upper support 106. In this fashion, the display frame 100 may be made more aesthetically pleasing to the viewer, or can be used for a secondary purpose, for example, by displaying a calendar on the upright member 102.

Figure 3:
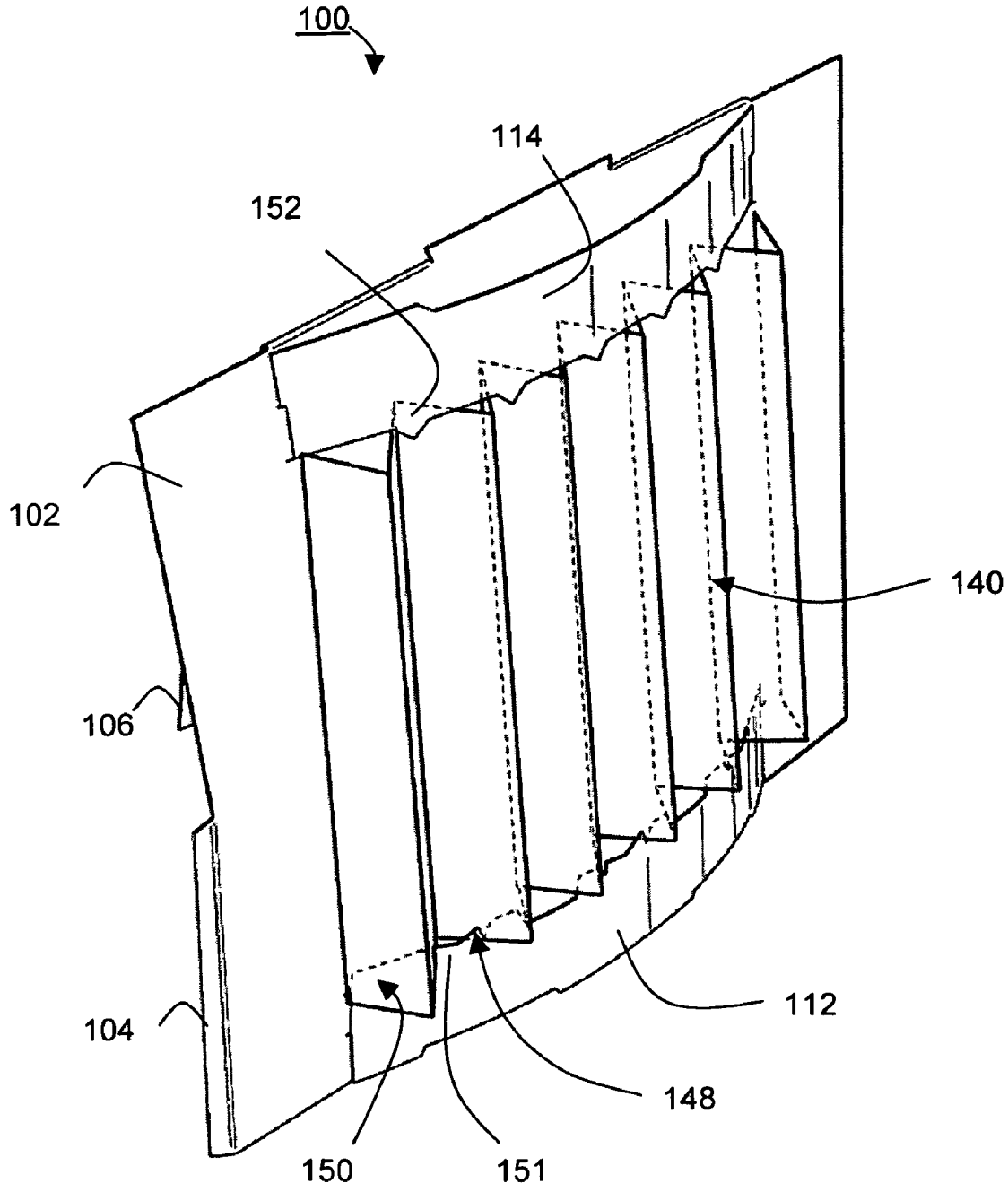
FIG. 3 is a perspective view of the assembled display frame of FIG. 1 with the kinetic artwork insert of FIG. 2*a;*

As shown, the lower band 112 and upper band 114 are contoured and curve outwards somewhat from the plane of the upright member 102. The lower band 112 provides a lower mount for the kinetic artwork insert 140 (as shown in FIG. 3). The lower band 112 is joined to upright member 102 by inserting tabs 130 into slots 132 in the upright member 102. The lower band 112 preferably contacts the ground surface, helping to support the upright member 102 in its substantially vertical position. The upper band 114 is similarly connected to the upright member 102 using tabs 134 engaged with slots 136 (shown in detail in FIG. 5) to provide an upper mount for the kinetic artwork insert 140.

The opening 110 in the upright member 102 allows for ambient light to pass through the display frame 100, to create a halo effect around the kinetic artwork insert 140, highlighting the images. Alternatively, in some embodiments an electric light or a candle may be mounted on or to the rear support flap 118 or base member to provide additional illumination through the opening 110. In some embodiments, a sound chip may be mounted to the base member 108 to provide music, speech or other sound-based accompaniment while viewing the image.

The display frame 100 is made from a resilient planar material, such as a thin sheet of cardboard. In some embodiments, the display frame can be made from materials such as plastic or foam sheet, cardstock, heavy paper or other suitably resilient materials. In one preferred embodiment, the display frame is made from a 20-point SBS cardboard.

With specific reference to FIG. 2, the display frame 100 is visible in a planar configuration before assembly. As shown, the lower band 112 and upper band 114 are initially joined to the display frame 100. The lower band 112 and upper band 114 are held together by a removable connecting piece 114*a*, and are connected to the base member 108 at a tear-off connection 112*a*. To assemble the display frame 100, the lower band 112 and upper band 114 are detached from the base member 108 by tearing along the tear-off connection 112*a*. The connecting piece 114*a* is removed, and the lower band 112 and upper band 114 can then be inserted into the upright member 102.

Figure 2A:
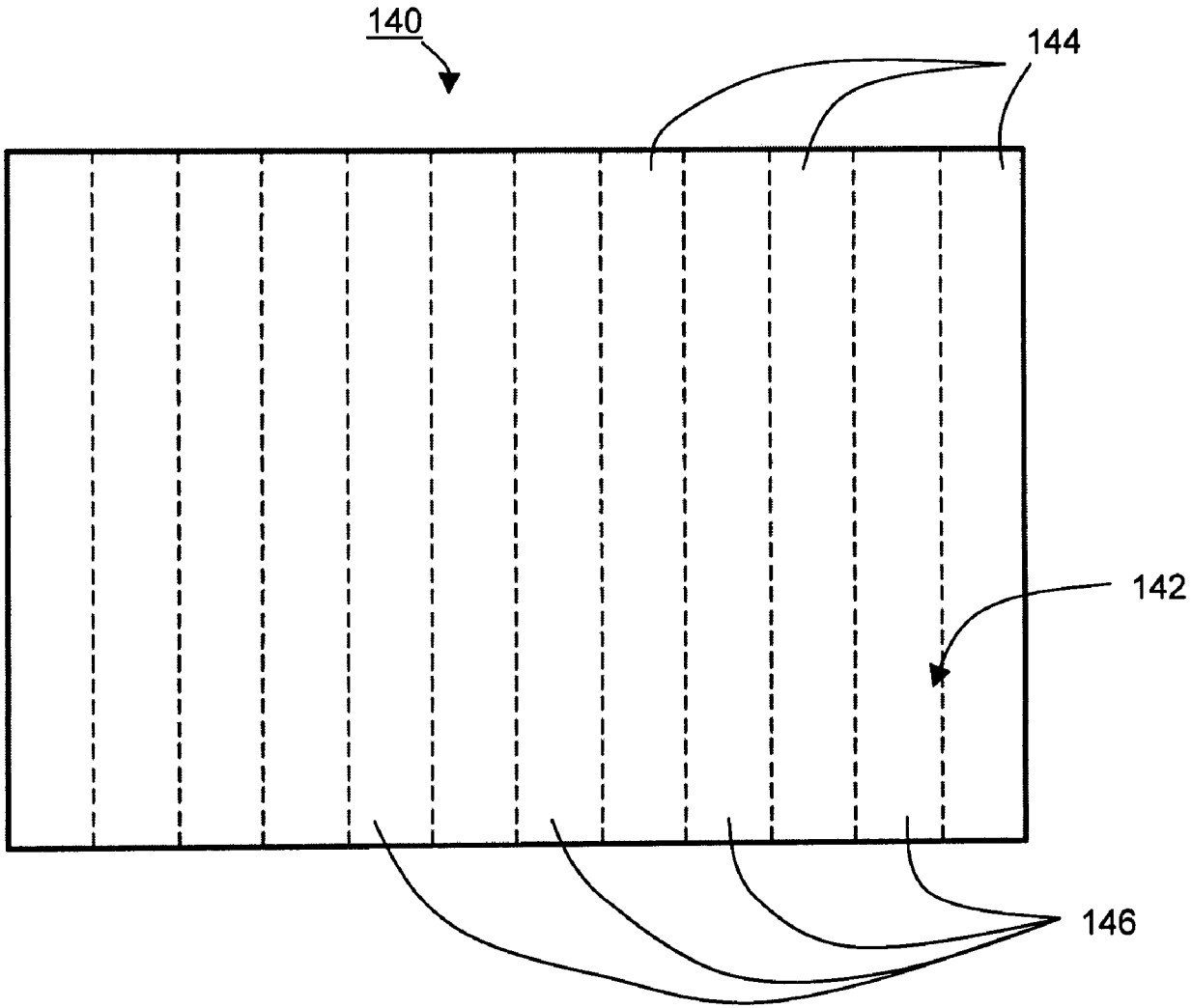
FIG. 2*a* is a plan view of a kinetic artwork insert in a planar configuration for use with the display frame of FIG. 1.

Turning now to FIG. 2*a*, the kinetic artwork insert 140 is shown in its planar configuration as a thin, rectangular section of a resilient material. The kinetic artwork insert 140 has a series of fold lines 142; folding along the fold lines 142 gives the kinetic artwork insert 140 its distinctive accordion-style or non-planar display configuration. In some embodiments, one or more of the fold lines 142 may include perforations to provide for easier folding. In other embodiments, the fold lines may simply be scored without perforating the material.

The kinetic artwork insert 140 comprises a series of alternating first image surfaces 144 and second image surfaces 146. The first image surfaces 144 comprise sections or strips from a first image, and the second image surfaces 146 comprise sections or strips from a second image. When the kinetic artwork insert 140 is folded into its non-planar display configuration, an observer will observe what appears to be the first image when viewing from a first location, and will observe what appears to be the second image when viewing from a second location.

In some embodiments, the kinetic artwork insert 140 is made of a material such as cardboard, cardstock or paper. In one preferred embodiment, the cardboard is 10-point SBS cardboard. In another preferred embodiment, the cardboard is 12-point SBS cardboard.

In some embodiments, the kinetic artwork insert 140 is pre-printed with an images, such that the sections from the first and second images are printed onto the corresponding first image surfaces 144 and second image surfaces 146 respectively. In other embodiments, the kinetic artwork insert 140 may be blank, and a user can populate the image surfaces 144, 146 using pre-cut or 'kiss-cut' stickers shaped to match the image surfaces 144, 146. In some embodiments, sheet of stickers may have the first and second images pre-printed thereon. In other embodiments, the sheet of stickers may be blank, and the user may draw, paint, or print first and second images onto the stickers before placing them onto the kinetic artwork insert 140. For example, the stickers may be provided on a 'kiss-cut' photo-paper, which can used to print first and second images using a standard inkjet printer, and then placed onto the kinetic artwork insert 140, maintaining the order of the strips so that the first and second images maintain the proper viewing relationship.

Figure 2B:
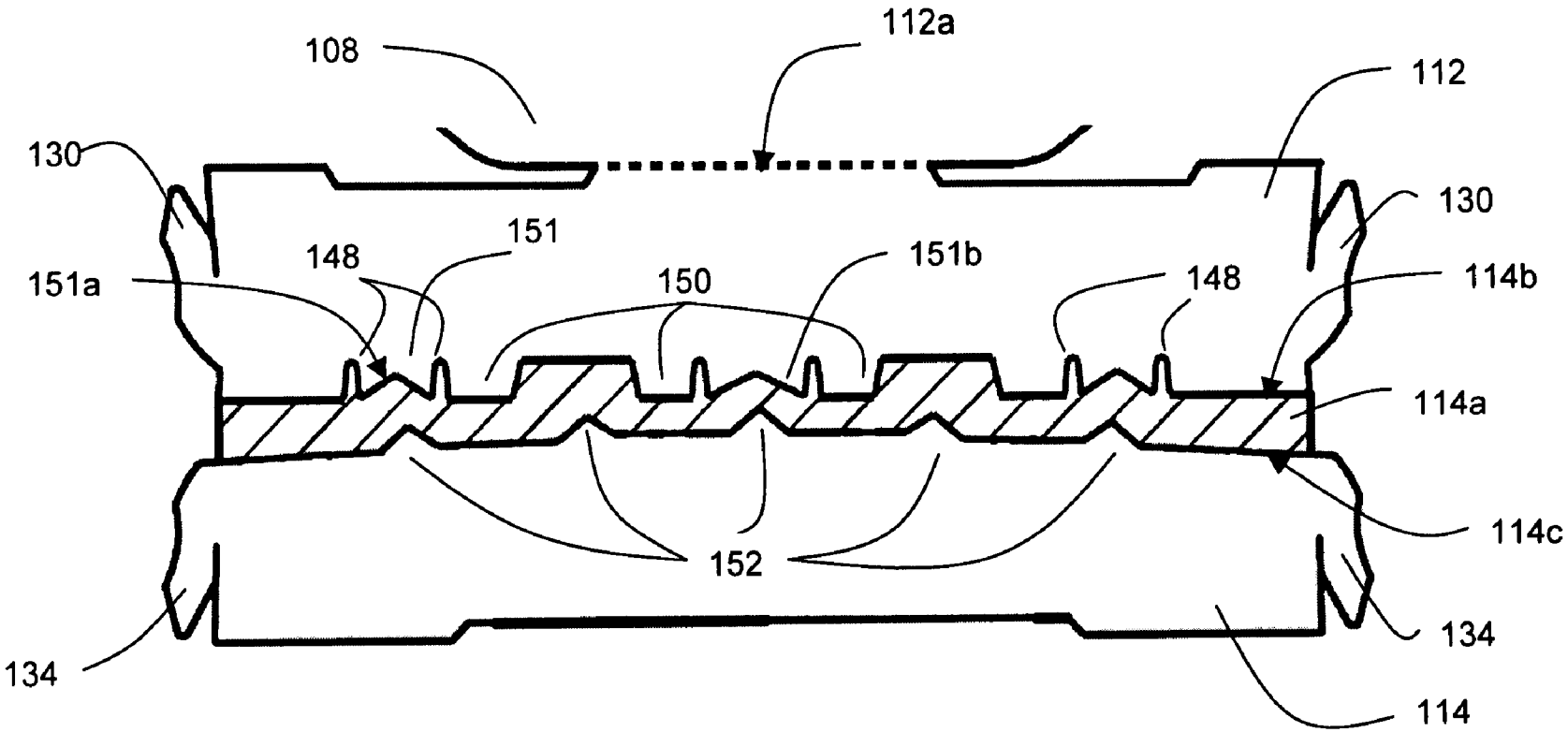
FIG. 2*b* is a plan view of a portion of the display frame of FIG. 2 showing two band members.

Turning now to FIG. 2*b*, the upper band 114 and the lower band 112 from FIG. 2 are shown in greater detail. The upper band 114 and the lower band 112 are joined by the connecting piece 114*a* along tear lines 114*b* and 114*c*. The lower band 112 is also connected to the base member 108 of the display frame 100 at the tear off-connection 112*a*. As discussed above, the upper and lower bands 112, 114 must be torn away from the base member 108 of the display frame 100 at the tear-off connection 112*a*, and the connecting piece 114*a* removed, before the lower band 112 and upper band 114 can be mounted to the upright member 102.

The tabs 130 on the lower band 112 and the tabs 134 on the upper band 114 can be seen in greater detail in FIG. 2*b*, and are shaped to engage with the slots 132 and 136 on the upright member 102. The lower band 112 also comprises a plurality of notches 148, rear tabs 150 and front tabs 151. The notches 148, rear tabs 150 and front tabs 151 are shaped and spaced along the lower band 112 to engage and secure the lower edge of the kinetic artwork insert 140 during assembly, and to ensure it maintains its non-planar or accordion-style shape, while staying flush with the upright member 102. Specifically, vertical sections of the kinetic artwork insert 140 are inserted into the notches 148, while the rear tabs 150 support from the rear of the kinetic artwork insert 140 and the front tabs 151 support from the front of the kinetic artwork insert 140. In the preferred embodiment, the notches 148 are generally U-shaped with walls that accommodate kinetic artwork inserts 140 of different thicknesses, or engage multiple kinetic artwork inserts 140 concurrently. The front tabs 151 may have v-shaped grooves 151 a cut out to provide improved viewing of the kinetic artwork insert 140 when mounted on the display frame 100, and to improve the aesthetic appearance of the display frame 100.

The upper band 114 optionally has teeth members 152 for engaging with and securing an upper edge of the kinetic artwork insert 140 to the display frame 100. The teeth members 152 on the upper band 114 are sized and spaced to secure the kinetic artwork insert 140 to the display frame, and to help the kinetic artwork insert 140 maintain its non-planar display configuration when inserted into the display frame 100.

Figure 4:
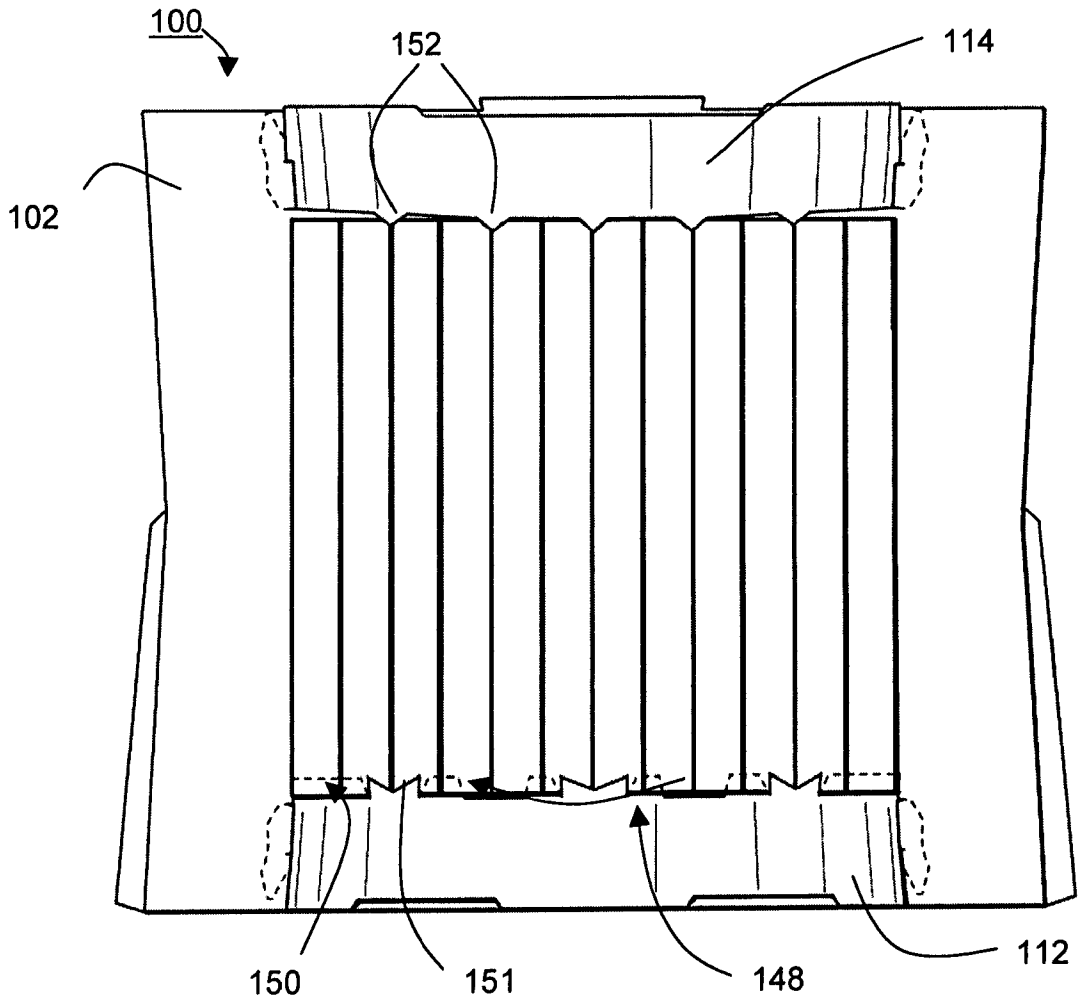
FIG. 4 is a front view of the assembled display frame and the kinetic artwork insert of FIG. 3.
Figure 4A:
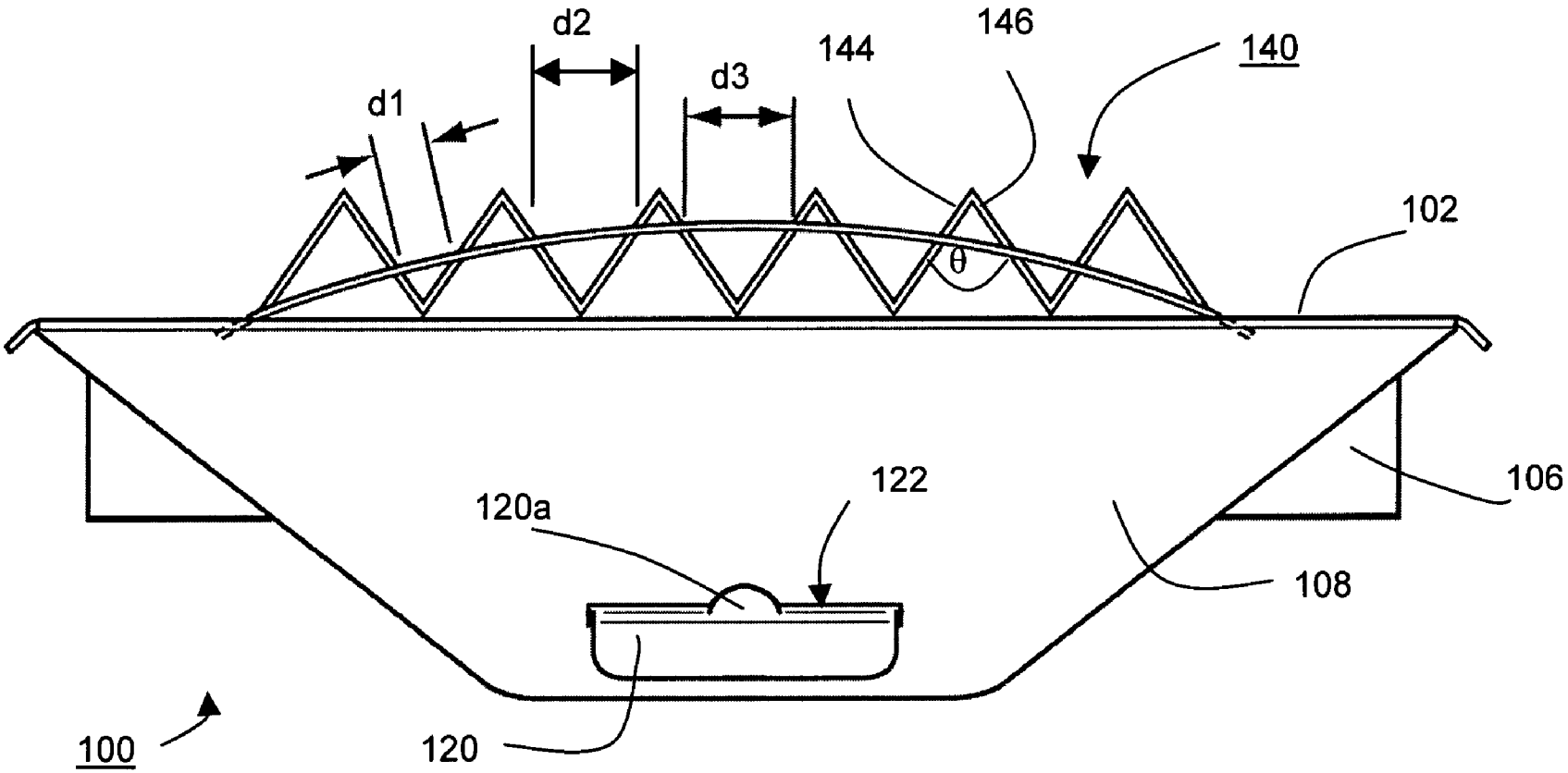
FIG. 4*a* is a bottom view of the assembled display frame and the kinetic artwork insert of FIG. 3.

Turning now to FIG. 3, FIG. 4 and FIG. 4*a*, the display frame 100 is shown assembled with kinetic artwork insert 140 in its non-planar display configuration. The kinetic artwork insert 140 sits in the notches 148 on the lower band 112, and is secured in place by the front tabs 151 which are visible and shown in solid lines, and the rear tabs 150, which are hidden and are shown in dashed lines. The teeth members 152 on the upper band 114 are shown engaged with the folds in the kinetic artwork insert 140.

In FIG. 4*a*, the position of the kinetic artwork insert 140 with respect to the lower band 112 is shown in detail. The first image surfaces 144 and the second image surfaces 146 are oriented at angle θ relative to each other. In a preferred embodiment, the angle θ between the first image surface 144 and the second image surface 146 is approximately 90 degrees to provide optimum viewing of the first and second images.

It is also desirable that the kinetic artwork insert 140 stay flush against the upright member 102 and not follow the curve of the lower band 112, as this ensures a better quality of image to the observer. It is also desirable that the angle θ be optimized for viewing. This is accomplished by properly selecting the size and spacing of the notches 148, the rear tabs 150 and front tabs 151 on the lower band 112. For example, with reference to FIGS. 4 and 4*a*, a first front tab 151*a* would have spacing 'd1' as shown at one end of the lower band 112, and a second front tab 151*b* would have spacing 'd3' as shown at the centre of the lower band 112. A third intermediate spacing is shown as 'd2'. Generally, 'd2' is slightly larger than 'd1', and 'd3' is slightly larger than 'd2', helping the kinetic artwork insert 140 to stay flush to the upright member 102 while accommodating the curvature of the lower band 112. It will be appreciated by those skilled in the art that the particular sizes and spacing of 'd1', 'd2' and 'd3' will depend upon the curvature of the lower band 112, as well as the particular size and shape of the kinetic artwork insert 140.

FIG. 4*a* also clearly shows the tab 120 of the rear support flap 118 engaged with the keyhole 122 of the base member 108, securing the rear support flap 118 to the base member 108. In some embodiments, such as the embodiment shown in FIG. 4*a*, a secondary tab 120*a* may be used to help secure the tab 120 to the base member 108. The tabs 120 and 120*a* project in opposite directions against the base member 108 thereby reducing the chance of inadvertent removal of tabs 120 and 120*a* from the keyhole 122.

Figure 5:
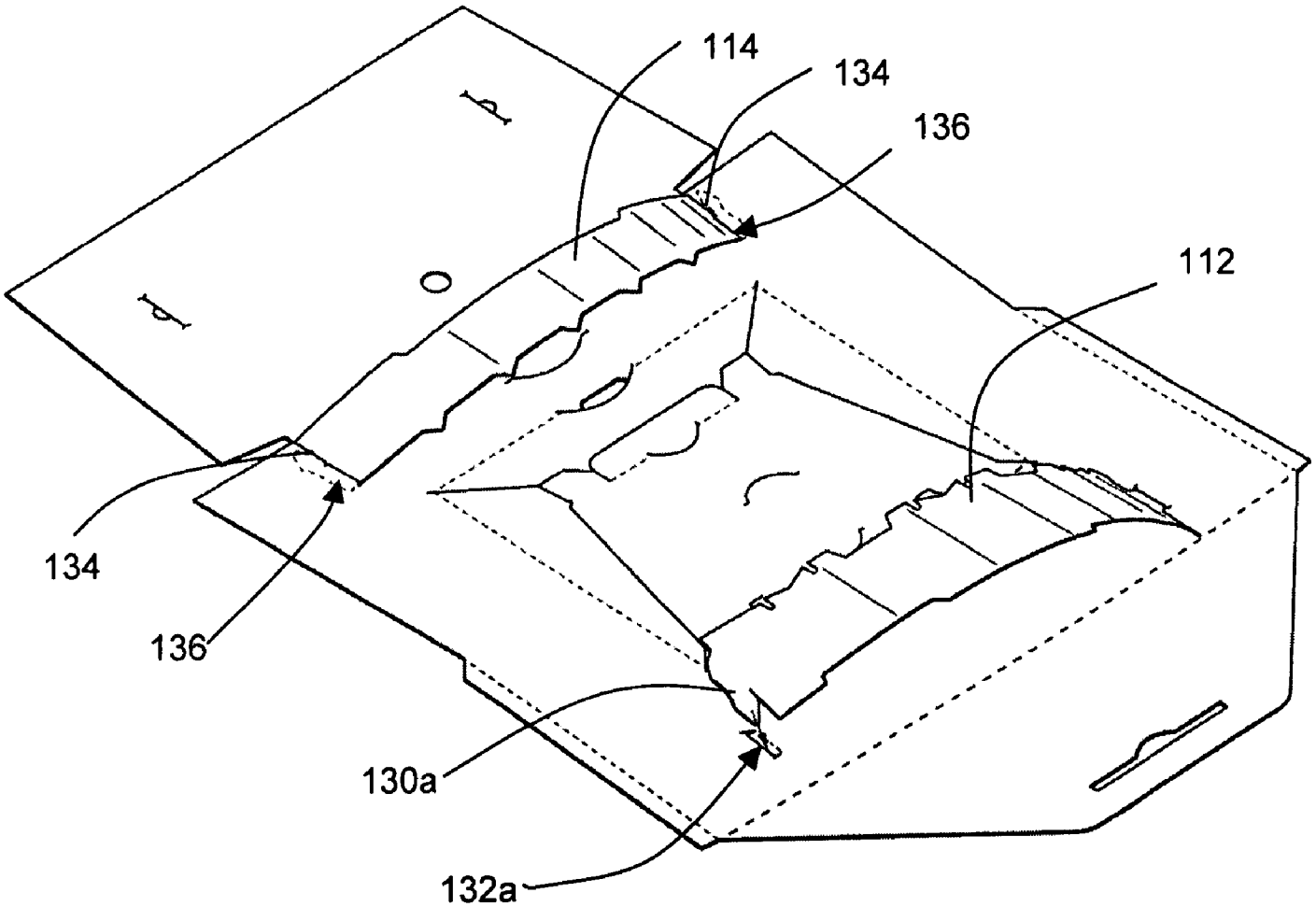
FIG. 5 is a perspective view of the display frame of FIG. 1 shown partially assembled.

In FIG. 5, the tabs 134 of the upper band 114 have been inserted into the slots 136 on the upright member 102, securing the upper band 114 to the upright member 102. The lower band 112 is partially secured to the upright member 120, and tab 130*a* is being inserted into slot 132*a* to completely secure the lower band 112 in place.

Figure 6:
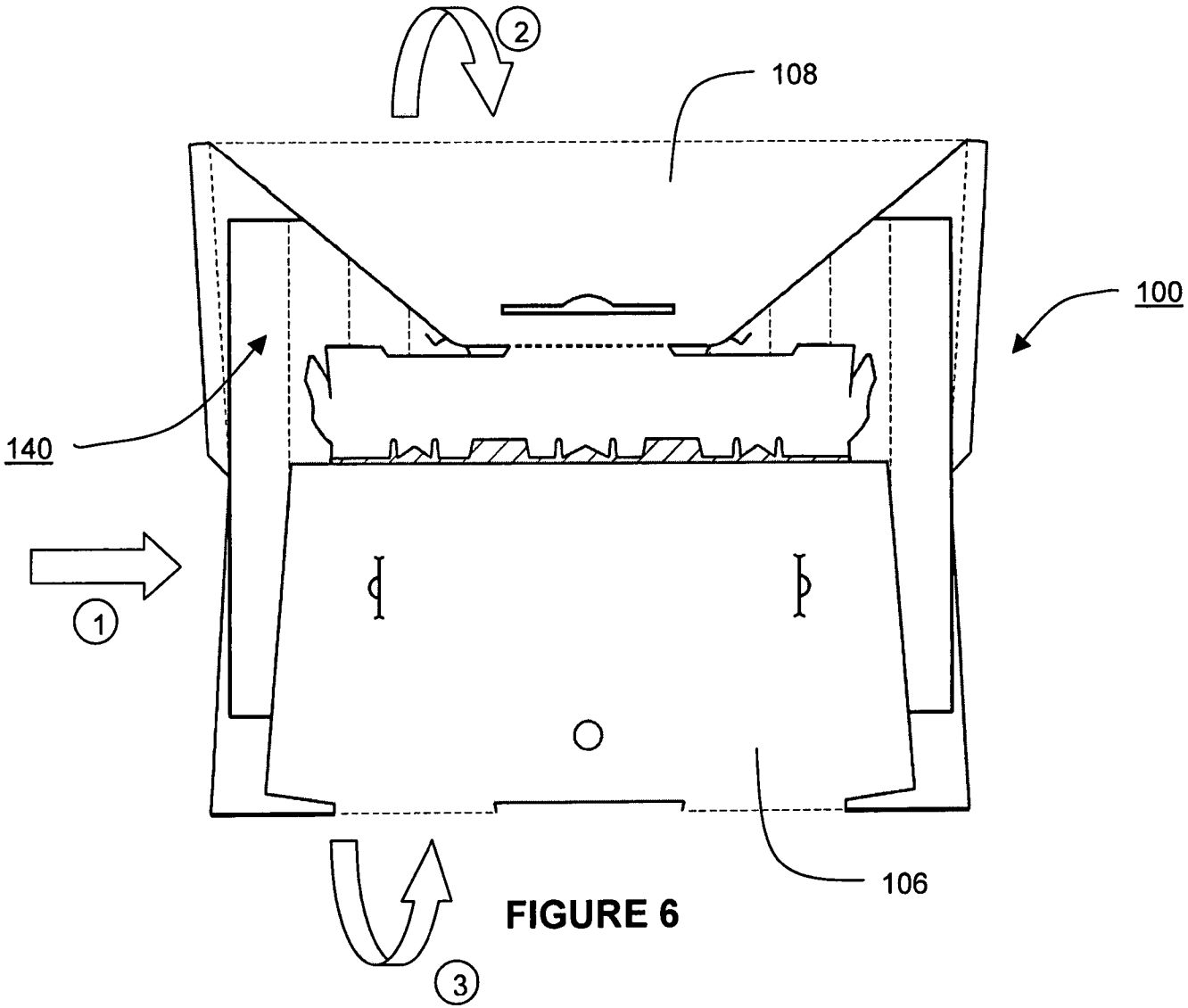
FIG. 6 is a plan view of an unassembled display frame with a kinetic artwork insert according to one embodiment of the invention.

Turning now to FIG. 6, the display frame 100 and kinetic artwork insert 140 of FIG. 2 have been prepared to use as an insert, for example in a plastic bag holding a magazine. In step 1, the kinetic artwork insert 140 is placed onto the upright member 102 of the unassembled display frame 100. In step 2, the base member 108 is then folded over to partially cover the kinetic artwork insert 140. In step 3, the upper support 106 is folded over to cover the base member 108 and the kinetic artwork insert 140. In this manner, the kinetic artwork insert 140 is protected by the folded base member 108 and upper support 106 of the display frame 100, and the entire assembly can be easily inserted into a plastic bag for distribution with a magazine, for example.

Figure 7A:
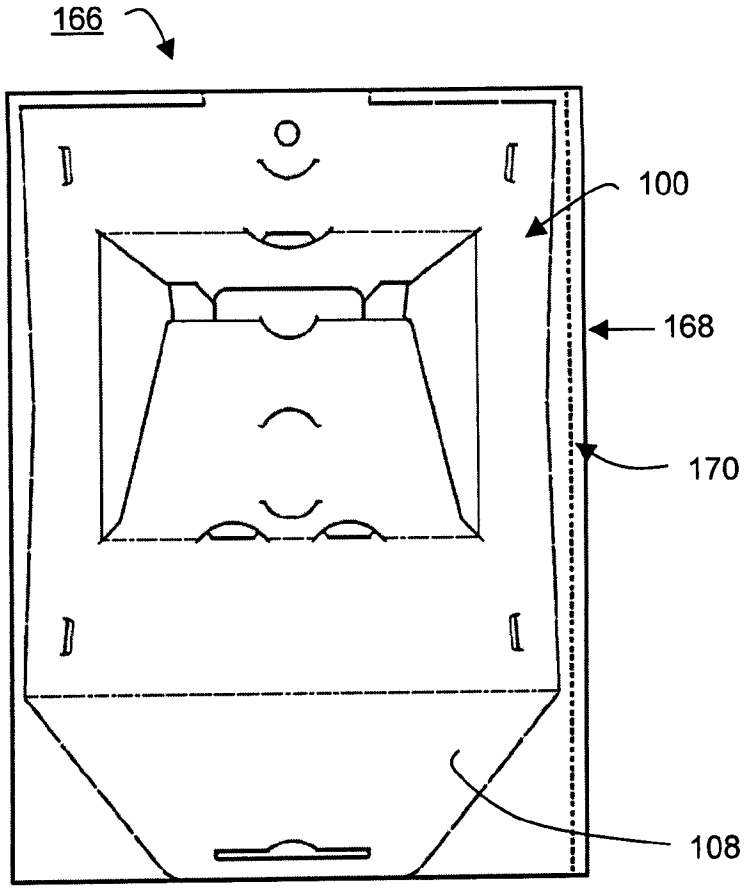
FIG. 7*a* is a plan view of an unassembled display frame for use with the kinetic artwork insert of FIG. 7.
Figure 7:
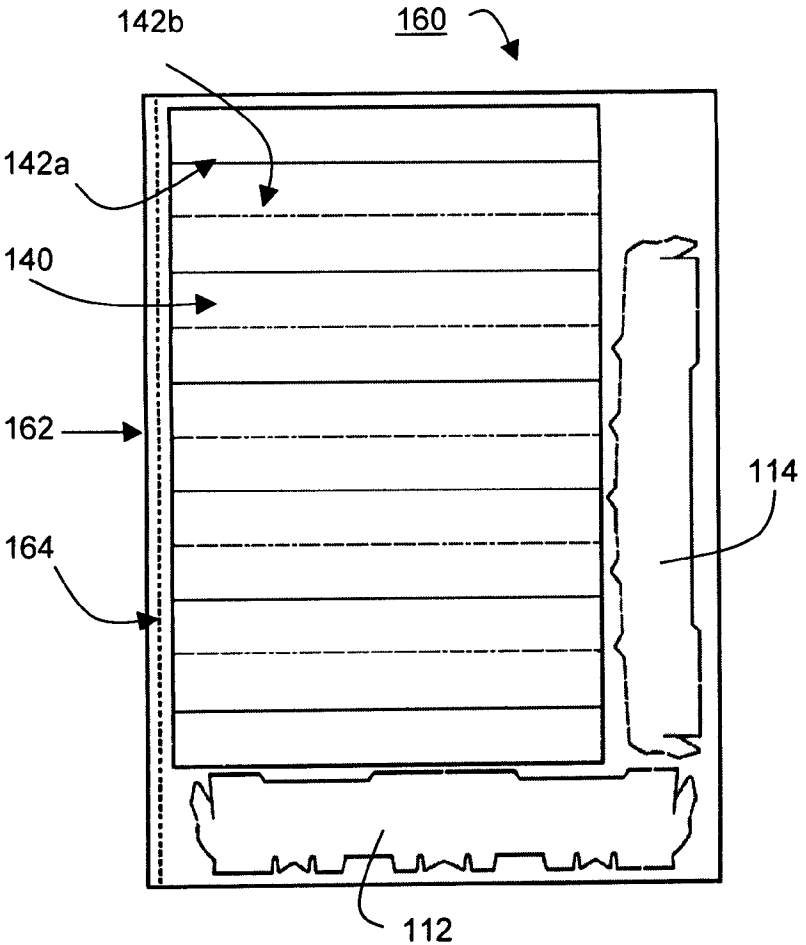
FIG. 7 is a plan view of an unassembled kinetic artwork insert according to another embodiment of the invention.

FIGS. 7 and 7*a* show a different embodiment of the invention for use as a detachable part of a book or magazine. For clarity, the same reference numerals are used to designate elements analogous to those described above in connection with FIGS. 1 to 5. The kinetic artwork insert 140 is included as part of an insert sheet 160 in such a way that it can be easily detached by providing perforated cut lines along the edges of the kinetic artwork insert 140. The upper band 114 and a lower band 112 are also included in the insert sheet 160 in a similar manner, and are easily removed. The kinetic artwork insert 140 shown in FIG. 7 has different types of parallel fold lines, included scored fold lines 142*a*, and perforated fold lines 142*b*. For the scored fold lines 142*a*, the sheet material of the kinetic artwork insert 140 has been creased but has not been perforated, while the perforated fold lines 142*b* comprise a series of cuts or holes passing through the material of the kinetic artwork insert 140. The combination of scored fold lines 142*a* and perforated fold lines 142*b* provides for improved folding.

The image sheet 160 is designed to be attached to a book or a magazine, using a spine edge 162, which is connected to the insert sheet 160 along tear line 164.

The display frame 100 shown in FIG. 7*a* is similarly included as part of a frame sheet 166, and the display frame 100 is provided with perforated cut lines along the edges to allow for easy removal. In this particular embodiment, the display frame 100 comprises generally an upright member 102 and a base member 108, with rear support flap 118, but has no upper support. Optionally, however, the frame sheet 166 may include an upper support 106.

The frame sheet 166 is designed to be attached to a book or magazine, using a second spine edge 168, which is connected along tear line 170.

Figure 7B:
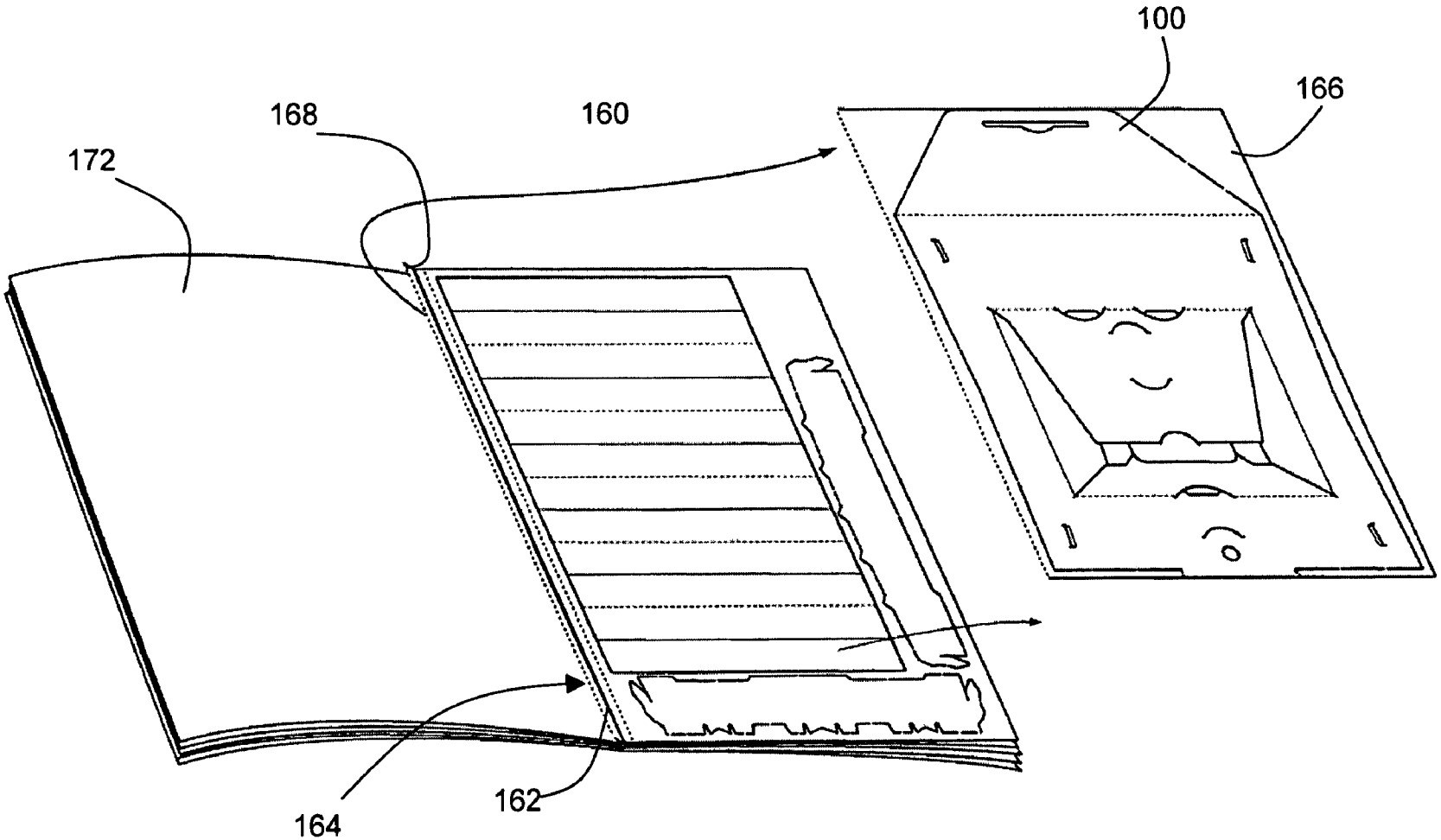
FIG. 7*b* is an exploded perspective view of a book with the display frame of FIG. 7*a* and the kinetic artwork insert of FIG. 7 attached.

As shown in FIG. 7*b*, the spine edges 162, 168 are joined with other pages in a book or magazine 172 using a typical binding process, for example by gluing or by stapling, to secure the image sheet 160 and the frame sheet 166 as part of the magazine 172. In one embodiment, the frame sheet 166 and image sheet 160 can be made from one large sheet, and be stapled at the centre of a book or magazine.

During assembly, the frame sheet 166 and image sheet 160 are removed from the book or magazine along the tear lines 164, 170. The individual components such as the display frame 100 can then be removed using the perforated cut lines, and assembled. It will be appreciated that the shapes and sizes of the image sheet 160 and the frame sheet 166 may be adjusted to accommodate books and magazines of different shapes and sizes.

In some embodiments of the invention, the book or magazine may include one or more sticker sheets having one or more images, which can be peeled off and mounted onto the kinetic artwork insert.

Figure 8A:
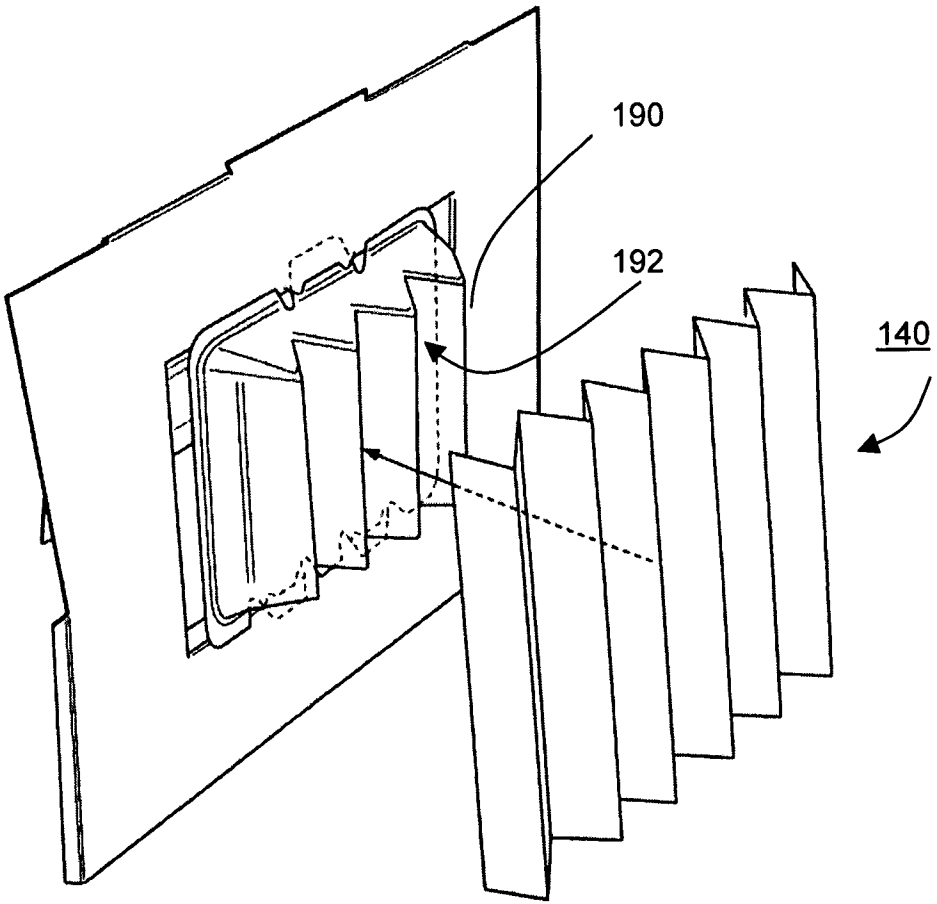
FIG. 8*a* is a perspective view of a kinetic artwork insert for mounting on the supporting insert of FIG. 8.
Figure 8:
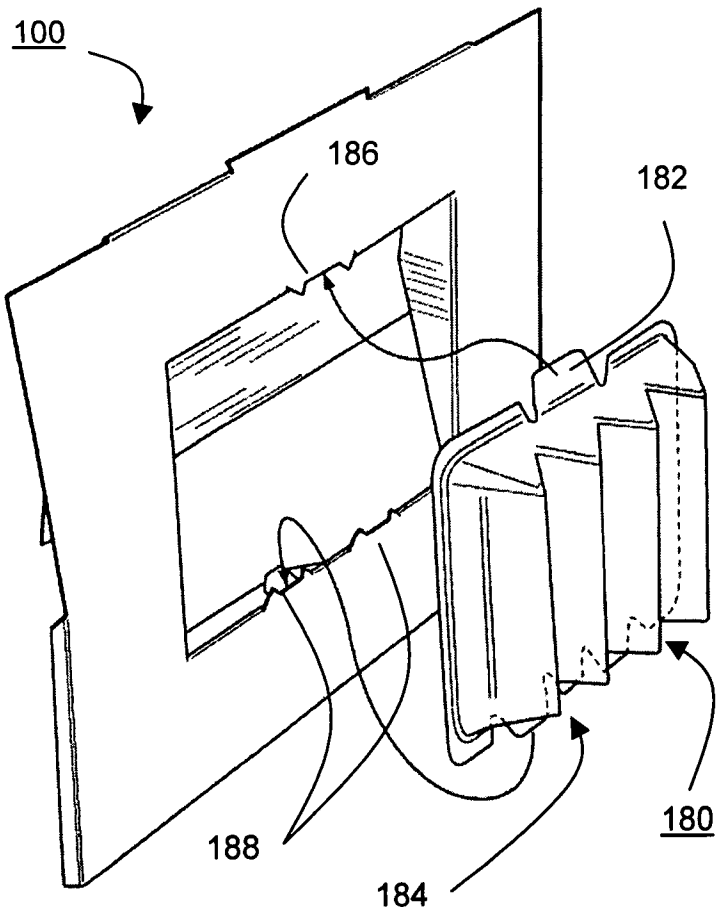
FIG. 8 is a perspective view of a display frame having a supporting insert according to another embodiment of the invention.

FIGS. 8, 8*a*, 9 and 9*a* show yet another embodiment of the invention. For clarity, the same reference numerals are used to designate elements analogous to those described above in connection with FIGS. 1 to 7*b*. As shown in FIGS. 8 and 8*a*, a shaped insert 180 is used to support the kinetic artwork insert 140 on the display frame 100. The shaped insert 180 resists deformation to support the kinetic artwork insert 140 in the non-planar or accordion-like configuration. In one embodiment, the shaped insert 180 is molded. The insert 180 has an upper tab 182 and a pair of lower tabs 184, for engagement with an upper slot 186 and a pair of lower slots 188, respectively, on the display frame 100. The insert 180 further comprises a series of peaks 190 and valleys 192, generally at angle θ relative to each other, and spaced to engage with the kinetic artwork insert 140 when in its non-planar display configuration.

In this embodiment, the insert 180 replaces the upper and lower bands 112, 114 in the above-described embodiments, secures the kinetic artwork insert 140 to the display frame 100, and ensures the kinetic artwork insert 140 remains in its non-planar display configuration. In some embodiments, the kinetic artwork insert 140 is releasably attachable to the insert 180 to allow different kinetic artwork inserts 140 to be used with the same insert 180. In some embodiments, the kinetic artwork insert 140 may be secured to the insert 180 using tape, sticky wax, or some other releasable means. The kinetic artwork insert 140 may also be glued to the insert 180 to provide a more permanent bond.

The insert 180 is preferably made from a generally light-weight, rigid material, for example a lightweight plastic or foam, cardboard or paper, or any other suitable material, such that it can secure the kinetic artwork insert 140 in its non-planar form to the upright member 102 without causing the display frame 100 to tip.

Figure 9:
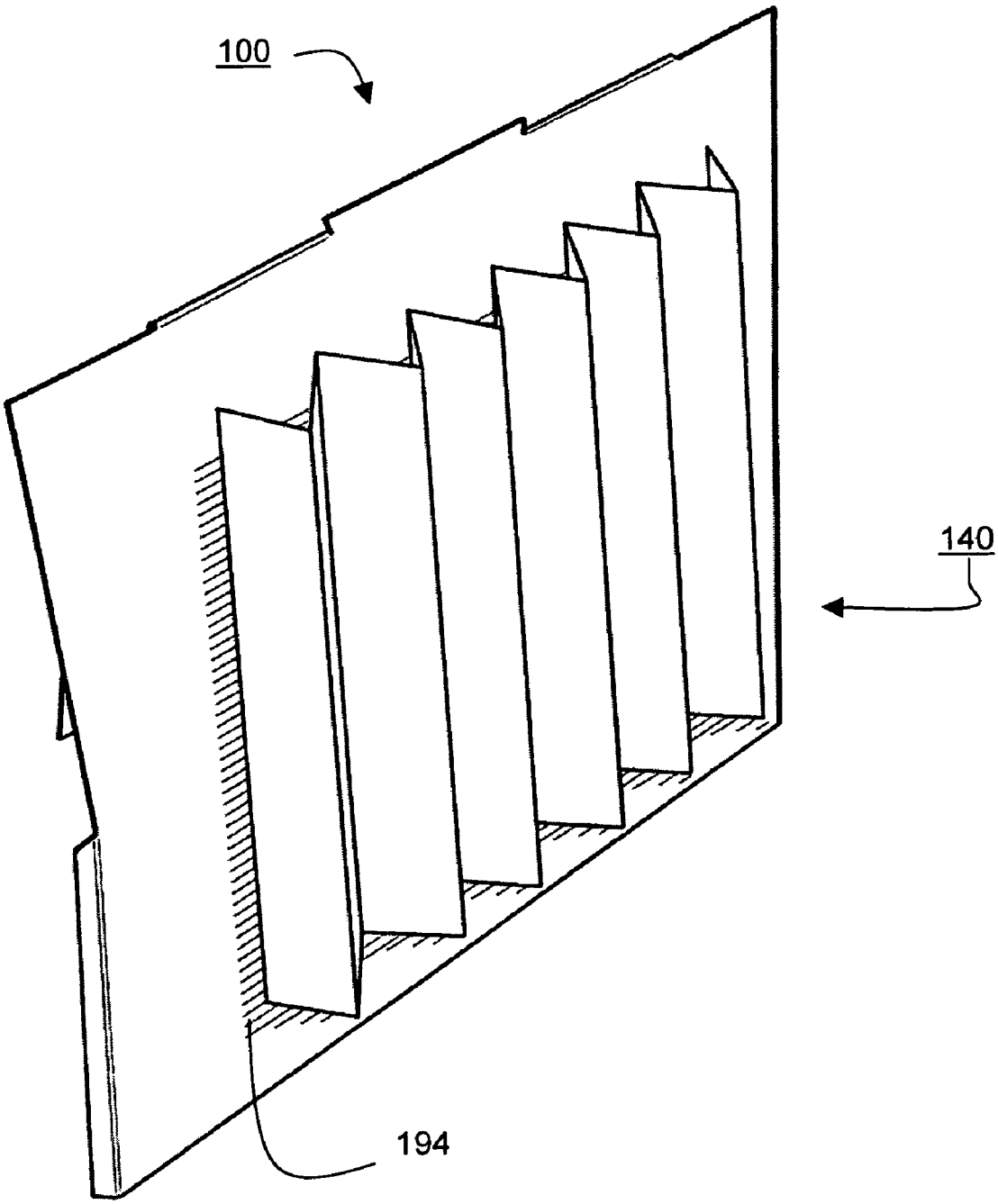
FIG. 9 is a perspective view of the kinetic artwork insert of FIG. 8*a* mounted to the display frame of FIG. 8.
Figure 9A:
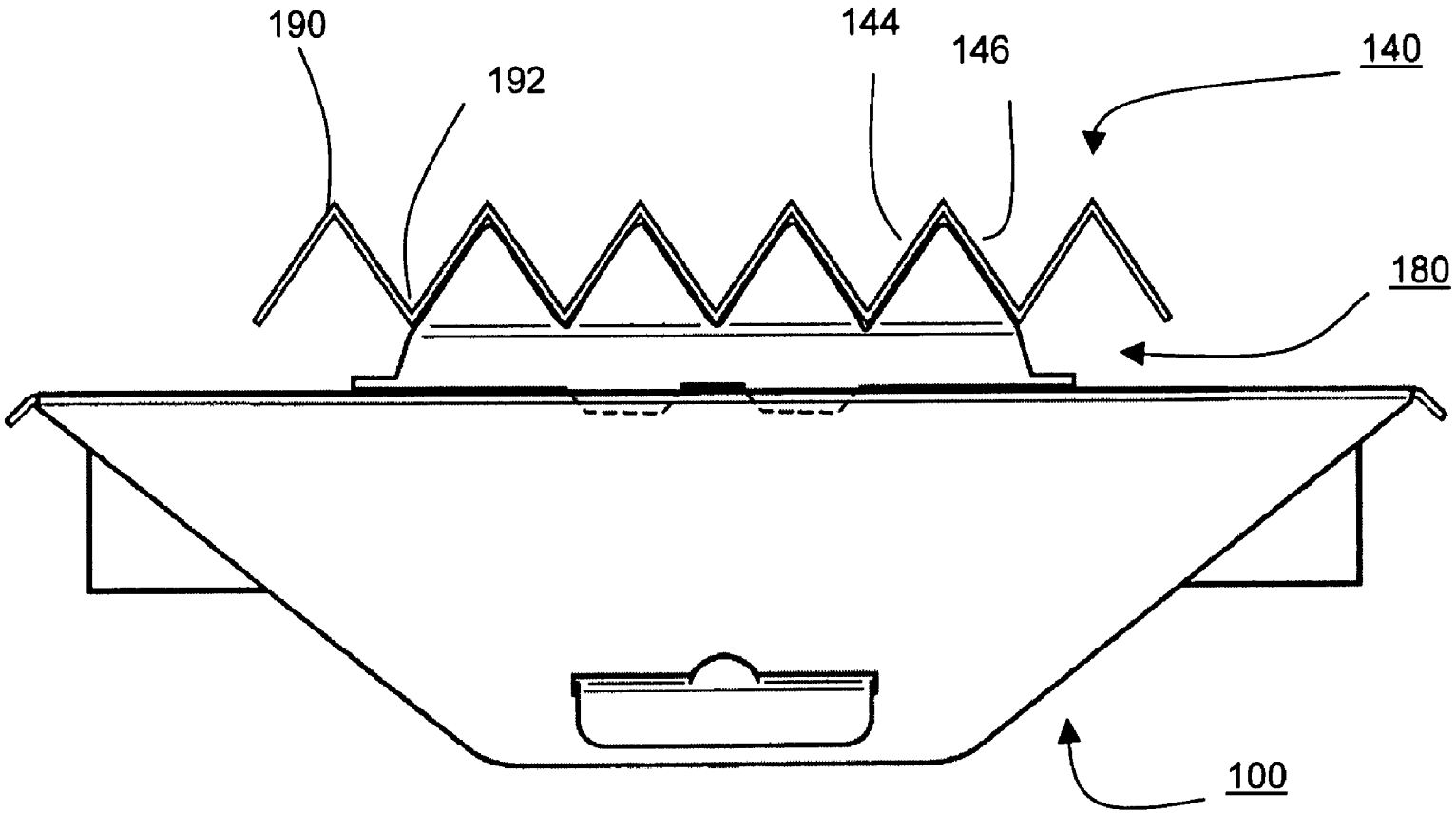
FIG. 9*a* is a bottom view of the kinetic artwork insert and display frame shown in FIG. 9.

With reference specifically to FIG. 9*a*, peaks 190 and valleys 192 of the insert 180 are clearly shown, engaged with the first image surfaces 144 and second image surfaces 146 on the kinetic artwork insert 140 to project the kinetic artwork insert 140 away from the upright member 102. In this fashion, the kinetic artwork insert 140 appears to the viewer to float in front of the upright member 102 while still maintaining the non-planar display configuration that facilitates perception of the first and second images by a viewer. In addition, a shadow 194 may be created around the kinetic artwork insert 140, which can further emphasize the images. Further, light passing through the opening 110 in the display frame 100 may create a halo effect around the kinetic artwork insert 140, further highlighting the images.

Turning now to FIGS. 10, 10*a* and 10*b*, there is illustrated a display frame 200 designed for use with the insert 180 discussed above, according to another embodiment. The display frame 200 comprises an upright member 202 having a generally curved shape such that no base member is needed to support the upright member 202 in an upright position, as best seen in FIG. 10*b*. Support fins 204 may optionally be present to provide additional stability.

The display frame 200 has a flat region 206, having an upper hook 208 and a pair of lower hooks 210, spaced and arranged to engage with the upper tab 182 and the lower tabs 184 on the insert 180. Thus, a kinetic artwork insert 140 can be mounted to display frame 200 using the insert 180.

The display frame 200 is made of a generally rigid material, such as a hard plastic or a metal. In preferred embodiments, the display frame 200 is made from a brushed aluminum or a stainless steel.

The invention has been described with regard to a number of embodiments. However, it will be understood by persons skilled in the art that other variants and modifications may be made without departing from the scope of the invention as defined in the claims appended hereto.

The invention claimed is:

1. A display assembly comprising;

(a) an image insert, the image insert being bendable from a planar configuration to a non-planar display configuration, wherein the image insert comprises a plurality of first surfaces for displaying a first image, and a plurality of second surfaces for displaying a second image; and (b) a display frame for supporting the image insert in the non-planar display configuration, wherein the display frame comprises an abutment structure for abutting the plurality of first surfaces and the plurality of second surfaces to secure the plurality of first surfaces at a non-zero angle relative to the plurality of second surfaces and to resist unbending of the image insert, the abutment structure comprises a set of abutments for abutting the plurality of first surfaces and the plurality of second surfaces, wherein each abutment in the set of abutments has a defined spacing and orientation relative to other abutments in the set of rigid abutments, the defined spacing and orientation being selected such that the set of abutments secures the plurality of first surfaces at a non-zero angle relative to the plurality of second surfaces, the image insert comprises a first edge and a second edge opposite the first edge, wherein the first edge and the second edge span the plurality of first surfaces and the plurality of second surfaces;

the abutment structure comprises a first band for contacting the first edge;

the set of abutments comprises a set of notches for receiving the first edge; and, each notch in the set of notches has a notch wall for abutting an associated surface of one of the plurality of first display surfaces and the plurality of second display surfaces.

2. The display assembly as defined in claim 1 wherein the image insert comprises a plurality of fold lines for separating the plurality of first surfaces and the plurality of second surfaces, wherein each first surface in the plurality of first surfaces is adjacent to an associated second surface in the plurality of second surfaces, and is separated from the associated adjacent second surface by an associated fold line in the plurality of fold lines.

3. The display assembly as defined in claim 1 wherein the set of abutments comprises a contoured support having a plurality of first support surfaces for orienting the plurality of first surfaces and a plurality of second support surfaces for orienting the plurality of second surfaces, wherein the plurality of first support surfaces are oriented at the non-zero angle relative to the plurality of second surfaces.

4. The display assembly as defined in claim 3 wherein the contoured support is substantially rigid to resist bending of the plurality of first support surfaces relative to the plurality of second surfaces.

5. The display assembly as defined in claim 4 wherein the contoured support is made of one of a lightweight foam and a lightweight plastic.

6. The display assembly as defined in claim 5 wherein the abutment structure further comprises a second band for contacting the second edge.

7. The display assembly as defined in claim 6 wherein the second band comprises a plurality of teeth for projecting in front of the plurality of fold lines.

8. The display assembly as defined in claim 6 wherein the display frame comprises a base support member for resting on a substantially horizontal surface to support the display frame and the image insert between the first band and the second band at a substantially vertical orientation; and a rear support member connected to the base support member for spacing the display frame from the base support member.

9. The display assembly as defined in claim 8 wherein, before assembly, the display frame and the image insert are substantially flat.

10. The display assembly as defined in claim 9 wherein, before assembly, the display frame comprises only a single sheet.

11. The display assembly as defined in claim 10 wherein the single sheet is made of one of resilient paper, cardboard and plastic.

12. The display assembly as defined in claim 9 wherein, before assembly, the single sheet comprises a pair of tear lines for detachably attaching the first band and the second band to the single sheet.

13. A book comprising (a) a plurality of pages, each page in the plurality of pages having a spine edge and a free edge opposite to the spine edge;

(b) a spine for securing the plurality of pages together, the spine being attached to the spine edge for each page in the plurality of pages;

(c) an image insert for displaying a first image and a second image, the image insert being bendable from a planar configuration to a non-planar display configuration, wherein the image insert comprises a plurality of first surfaces for displaying a first image, and a plurality of second surfaces for displaying a second image; and (d) a display frame for supporting the image insert in the non-planar display configuration, wherein the display frame comprises an abutment structure for abutting the plurality of first surfaces and the plurality of second surfaces to secure the plurality of first surfaces at a non-zero angle relative to the plurality of second surfaces and to resist unbending of the image insert;

wherein, before assembly, the image insert is detachably attached to one of the spine and at least one page in the plurality of pages in the planar configuration, and the display frame is detachably attached to one of the spine and at least one page in the plurality of pages; and, wherein the plurality of pages comprises a first sticker page for showing the first image and a second sticker page for showing the second image, wherein the first sticker page comprises a plurality of first image stickers, the plurality of first image stickers being detachable from the first sticker page and attachable to the plurality of first surfaces of the image insert, and the second sticker page comprises a plurality of second image stickers, the plurality of second image stickers being detachable from the second sticker page and attachable to the plurality of second surfaces of the image insert.

14. The book as defined in claim 13 wherein, before assembly, the display frame and the image insert are contained within at most two sheets.

15. The book as defined in claim 13 wherein, before assembly, the display frame and the image insert comprise separate sheets.

16. The book as defined in claim 14 wherein the single sheet is made of one of resilient paper, cardboard and plastic.

17. The book as defined in claim 15 wherein the single sheet is made of one of resilient paper, cardboard and plastic.

* * * * *